US009929481B2

(12) United States Patent
Tatzel et al.

(10) Patent No.: US 9,929,481 B2
(45) Date of Patent: Mar. 27, 2018

(54) PLUG-TYPE CONNECTOR

(71) Applicant: Rosenberger Hochfrequenztechnik GmbH & Co. KG, Fridolfing (DE)

(72) Inventors: Frank Tatzel, Ostermiething (AT); Georg Schiele, Waging am See (DE); Christian Dandl, Fridolfing (DE); Christian Maier, Griesstätt (DE); Herbert Babinger, Kirchanschöring (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 0 days.

(21) Appl. No.: 14/776,335

(22) PCT Filed: Feb. 11, 2014

(86) PCT No.: PCT/EP2014/000372

§ 371 (c)(1),
(2) Date: Sep. 14, 2015

(87) PCT Pub. No.: WO2014/139622

PCT Pub. Date: Sep. 18, 2014

(65) Prior Publication Data

US 2016/0043482 A1 Feb. 11, 2016

(30) Foreign Application Priority Data

Mar. 15, 2013 (DE) ..... 20 2013 002 575 U

(51) Int. Cl.
*H01R 9/05* (2006.01)
*H01R 13/622* (2006.01)
*H01R 24/40* (2011.01)
*H01R 103/00* (2006.01)

(52) U.S. Cl.
CPC ..... *H01R 9/0521* (2013.01); *H01R 13/622* (2013.01); *H01R 24/40* (2013.01); *H01R 2103/00* (2013.01)

(58) Field of Classification Search
CPC .... H01R 9/0521; H01R 13/622; H01R 24/40; H01R 2103/00
USPC ..... 439/578
See application file for complete search history.

(56) References Cited

U.S. PATENT DOCUMENTS 4,719,697 A 1/1988 Schwartzman
5,681,177 A 10/1997 Mikolaicyk et al.
5,683,263 A * 11/1997 Hsu ..... H01R 13/6477 439/311
6,840,803 B2 * 1/2005 Wlos ..... H01R 9/0518 439/578
6,953,359 B1 10/2005 Morelli
(Continued)

FOREIGN PATENT DOCUMENTS

CN 101916949 A 12/2010
CN 102544893 A 7/2012
(Continued)

*Primary Examiner* — Abdullah Riyami
*Assistant Examiner* — Nelson R Burgos-Guntin
(74) *Attorney, Agent, or Firm* — David P. Dickerson

(57) ABSTRACT

A plug-type connector comprising a conductor and a union nut mounted rotatably on the conductor, wherein the union nut is mounted in a sprung manner on the conductor in the axial direction of the plug-type connector.

20 Claims, 2 Drawing Sheets

(56) References Cited

U.S. PATENT DOCUMENTS

| | | | | |
|---|---|---|---|---|
| 7,018,235 | B1 * | 3/2006 | Burris | H01R 9/0518 439/578 |
| 7,029,326 | B2 * | 4/2006 | Montena | H01R 9/0524 439/578 |
| 7,108,547 | B2 * | 9/2006 | Kisling | H01R 9/0524 439/578 |
| 7,131,868 | B2 * | 11/2006 | Montena | H01R 9/0518 439/578 |
| 7,393,214 | B2 * | 7/2008 | DiStefano | H01R 13/2407 439/66 |
| 7,491,069 | B1 * | 2/2009 | Di Stefano | G01R 1/0491 439/74 |
| 8,011,955 | B1 * | 9/2011 | Lu | H01R 9/0524 439/585 |
| 8,328,577 | B1 * | 12/2012 | Lu | H01R 9/05 439/578 |
| 8,690,602 | B2 * | 4/2014 | Flaherty, IV | H01R 13/111 439/578 |
| 8,753,137 | B2 * | 6/2014 | Lu | H01R 9/0521 439/322 |
| 8,801,448 | B2 * | 8/2014 | Purdy | H01R 9/0524 439/322 |
| 8,858,251 | B2 * | 10/2014 | Montena | H01R 9/05 439/322 |
| 8,968,025 | B2 * | 3/2015 | Shaw | H01R 9/0521 439/578 |
| 9,017,101 | B2 * | 4/2015 | Ehret | H01R 9/05 29/874 |
| 9,203,167 | B2 * | 12/2015 | Holliday | H01R 9/05 |
| 9,300,063 | B2 * | 3/2016 | Tatzel | H01R 12/714 |
| 2002/0050062 | A1 | 5/2002 | Sato | |
| 2006/0194474 | A1 * | 8/2006 | Montena | H01R 9/0518 439/578 |
| 2007/0269999 | A1 * | 11/2007 | Di Stefano | G01R 1/0466 439/73 |
| 2011/0021041 | A1 * | 1/2011 | Galloway | H01R 13/627 439/63 |
| 2012/0122329 | A1 | 5/2012 | Montena | |
| 2012/0196476 | A1 * | 8/2012 | Haberek | H01R 9/05 439/578 |
| 2012/0202379 | A1 * | 8/2012 | Rodrigues | H01R 9/0524 439/583 |
| 2012/0214340 | A1 * | 8/2012 | Weiss | H01P 5/103 439/578 |
| 2012/0214341 | A1 * | 8/2012 | Huang | H01R 13/5202 439/583 |
| 2012/0225581 | A1 * | 9/2012 | Amidon | H01R 9/0524 439/584 |
| 2013/0122753 | A1 * | 5/2013 | Blakborn | H01R 9/032 439/660 |
| 2014/0080357 | A1 * | 3/2014 | Rosenberger | H01R 13/622 439/578 |
| 2014/0329421 | A1 * | 11/2014 | Tatzel | H01R 12/714 439/816 |
| 2015/0180182 | A1 * | 6/2015 | Tatzel | H01R 13/24 439/578 |
| 2016/0043482 | A1 * | 2/2016 | Tatzel | H01R 13/622 439/578 |

FOREIGN PATENT DOCUMENTS

| | | | |
|---|---|---|---|
| CN | 202308399 | U | 7/2012 |
| CN | 102751617 | A | 10/2012 |
| CN | 202737225 | U | 2/2013 |
| DE | 2043644 | A1 | 3/1911 |
| DE | 4300243 | C1 | 3/1994 |
| DE | 60204369 | T2 | 3/2006 |
| DE | 202007014058 | U1 | 2/2008 |
| EP | 0 052 535 | | 5/1982 |
| EP | 1054494 | A2 | 10/2000 |
| JP | 2005259404 | A | 9/2005 |

* cited by examiner

PLUG-TYPE CONNECTOR

BACKGROUND OF THE INVENTION

1. Field of the Invention

The invention relates to an insertion-type connector and in particular to a co-axial radio-frequency insertion-type connector, and to an insertion-type connection formed by an insertion-type connector of this kind and a mating insertion-type connector complementary thereto.

2. Description of Related Art

In many known radio-frequency insertion-type connections, the making of contact between at least the outer conductors of the two insertion-type connectors takes place (among other ways) axially, i.e. contact-making faces at the ends of the outer conductors butt against one another when the insertion-type connections are in the plugged together state. To achieve transmission of radio-frequency signals through the insertion-type connections which is as free as possible of intermodulation and reflection, a comparatively high contact-making pressure is usually required. In many insertion-type connections this is produced by means of a union nut which is arranged to be rotatable on the shell of one of the insertion-type connectors, this shell often being formed by the outer conductor, and which has an inside thread which can be screwed onto an outside thread on a shell of the other insertion-type connector, this shell often being formed by the outer conductor. The screwing-up of the union nut moves the two insertion-type connectors relative to one another in the direction defined by their longitudinal axes (which corresponds to the direction of insertion) and thereby produces the axial contact-making pressure. The union nut then also ensures that the insertion-type connectors are held fixed durably, but in such a way as to be releasable again, when the radio-frequency insertion-type connection is in the plugged together state. A radio-frequency insertion-type connection of this kind is known from, for example, DE 43 00 243 C1.

In screwed connections in general, self-loosening may occur due to relaxation but the connections are usually secured against this. There are a large number of securing members available for this purpose such for example as disc springs, shake proof washers and spring washers.

There are various reasons why securing members of this kind have not so far been used for the securing of the screwed joint in a screwed connection fixed with a union nut. One reason is the space which is not usually available for incorporating a securing member of this kind. Another reason is the restricting of the convenience of use when, once the insertion-type connection has been plugged together, it has to be checked that a securing member is present and is correctly seated. And finally, the securing member must not cause any adverse change in the electrical transmission characteristics, as the securing member would in radio-frequency insertion-type connections if it were arranged between the axial contact-making faces.

In known radio-frequency insertion-type connections, securing against self-loosening is therefore usually accomplished by tightening the union nut to a comparatively high tightening torque which will compensate for the relaxation which can be expected of the screwed connection. This however makes it difficult for the insertion-type connection to be plugged together and may also result in damage to the insertion-type connectors involved.

SUMMARY OF THE INVENTION

Taking the above prior art as a point of departure, the object underlying the invention was to specify an improved insertion-type connection, fixed by means of a union nut, which was secured against self-loosening of the union nut in particular even at comparatively low tightening torques.

This object is achieved by an insertion-type connector according to the description delineated herein as well as the claims, comprising an insertion-type connector and a mating insertion-type connector complementary thereto. Advantageous embodiments of the insertion-type connector according to the invention are the subject matter of the present invention and the claims, and can be seen from the following description of the invention.

The above and other objects, which will be apparent to those skilled in the art, are achieved in the present invention which is directed to an insertion-type connector comprising a conductor and a union nut rotatably mounted on the conductor, wherein the union nut is resiliently mounted on the conductor in the axial direction of the insertion-type connector. The insertion-type connector includes an annular spring stressed in bending for mounting the union nut on the conductor. The annular spring stressed in bending may take the form of a wave spring washer.

The inside of the annular spring stressed in bending may be arranged in a groove in the conductor and/or its outside is arranged in a groove in the union nut.

The insertion-type connector preferably takes the form of a co-axial insertion-type connector with the conductor, in the form of an outer conductor, surrounding a center conductor.

In a second aspect, the present invention is directed to an insertion-type connection having an insertion-type connector comprising a conductor and a union nut rotatably mounted on the conductor, wherein the union nut is resiliently mounted on the conductor in the axial direction of the insertion-type connector, and a mating insertion-type connector, wherein the mating insertion-type connector has a thread which co-operates with the union nut.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
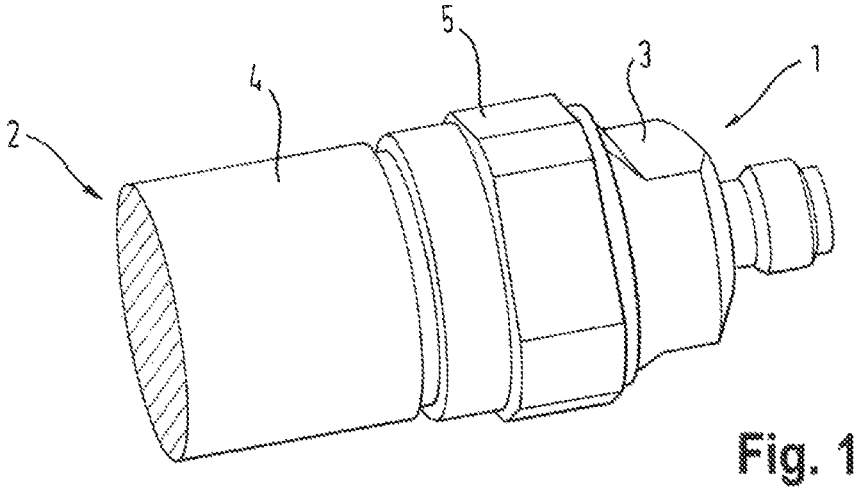
FIG. 1 is a perspective view of an insertion-type connection according to the invention when the union nut is not fully screwed up.

In describing the preferred embodiment of the present invention, reference will be made herein to FIGS. 1-6 of the drawings in which like numerals refer to like features of the invention.

An insertion-type connector of the generic kind, and in particular a radio-frequency insertion-type connector having a (or at least one) conductor and having a (or at least one) union nut which is rotatably mounted on the conductor and which has a thread and in particular an inside thread, is characterized in accordance with the invention in that the union nut is resiliently mounted on the conductor in the axial direction of the insertion-type connector.

The incorporation of a resilient member in the mounting of the union nut on the conductor avoids the incorporation of such a member in the interior of the insertion-type connector, where there is usually no room for it. Also, the design according to the invention of the insertion-type connector provides an opportunity for the resilient member to be arranged off the signal path for radio-frequency signals, thus making it possible for any adverse effect on the RF transmission characteristics of the insertion-type connector to be substantially ruled out. And finally, because the resilient member is situated away from the insertion interface, there are no problems in achieving for the insertion-type connector according to the invention compatibility with conventional, and in particular standardized (e.g. standardized to DIN 47 223, DIN 47 281, DIN 47 295 and DIN 47 297) mating insertion-type connectors.

Provision may preferably be made for the resilient member to take the form of an annular spring stressed in bending, i.e., the union nut is mounted on the conductor by means of an (or at least one) annular spring stressed in bending. This is a design of simple construction which is notable for requiring only a small amount of space.

As a particular preference, the annular spring stressed in bending may take the form in this case of a wave washer, because comparatively high resilience can be achieved with a wave washer, even when its dimensions are small. Alternatively, other springs stressed in bending, and in particular disc springs, may also be used although these, when there is a preset maximum resilience, usually have to be relatively large in volume compared to a wave washer, as a result of which the outside dimensions of the insertion-type connector might increase in a disadvantageous way.

A particularly advantageous way of incorporating the annular spring stressed in bending may make provision for its inside to be arranged in a groove in the conductor and/or its outside to be arranged in a groove in the union nut.

The insertion-type connector according to the invention may preferably take the form of a co-axial insertion-type connector with the conductor, in the form of an outer conductor, surrounding a center conductor. Due to the shielding action which the outer conductor is able to perform in relation to the signal-carrying center conductor, co-axial insertion-type connectors have an advantageous suitability for what they are preferably intended for in this case, namely the transmission of radio-frequency signals.

An insertion-type connection according to the invention comprises, as well as a (or at least one) insertion-type connector according to the invention, a (or at least one) mating insertion-type connector, with the mating insertion-type connector having a thread, and in particular an outside thread, which co-operates with the union nut.

The embodiment of insertion-type connection according to the invention which is shown in the drawings comprises an insertion-type connector in the form of a plug 1 and a mating insertion-type connector in the form of a coupler 2 into which it fits. The plug 1 is intended for connection to another series of plugs (not shown) and thus constitutes an adapter. The coupler 2 on the other hand is intended for connection to a housing (not shown) and thus constitutes a housing coupler.

The two insertion-type connectors are in the form of single insertion-type connectors and comprise respective conductors 3, 4.

The plug 1 comprises a union nut 5 having an inside thread. The union nut 5 is rotatably mounted on the conductor 3 of the plug 1. For this purpose, the union nut 5 comprises, on its inside, a groove 6 extending round in a loop in which the outside of a spring stressed in bending, in the form of a wave spring washer 7, engages. What is more, the conductor 3 comprises, on its outside, a groove 8 extending around in a loop in which the inside of the wave spring washer 7 engages. The grooves 6, 8 are of a width in this case which is wider than the cross-section (which is constant in the longitudinal direction) of the body of the wave spring washer. The width of the grooves preferably corresponds to approximately the overall extent of the wave spring washer 7 in the direction defined by its longitudinal axis when it is unloaded or only slightly pre-loaded. What is accomplished by the wave spring washer 7 is that the union nut 5 is mounted on the conductor 3 of the plug 1 in such a way as to be rotatable and secured in the axial direction and to be allowed merely a limited, spring-loaded movement.

Figure 2:
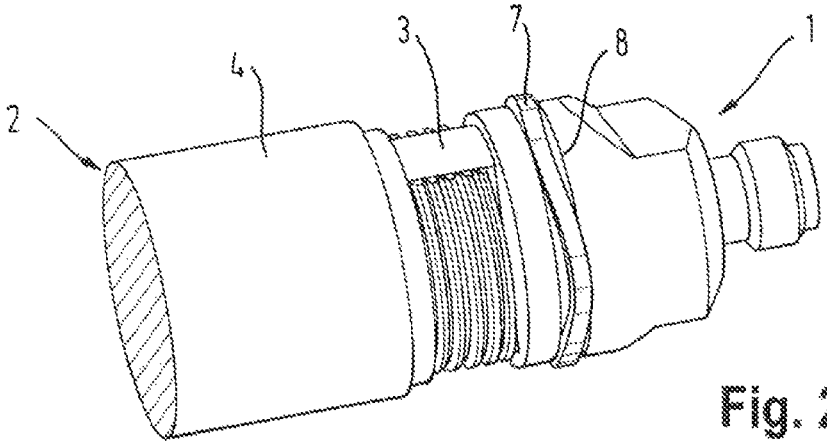
FIG. 2 shows the insertion-type connection with the union nut removed.
Figure 3:
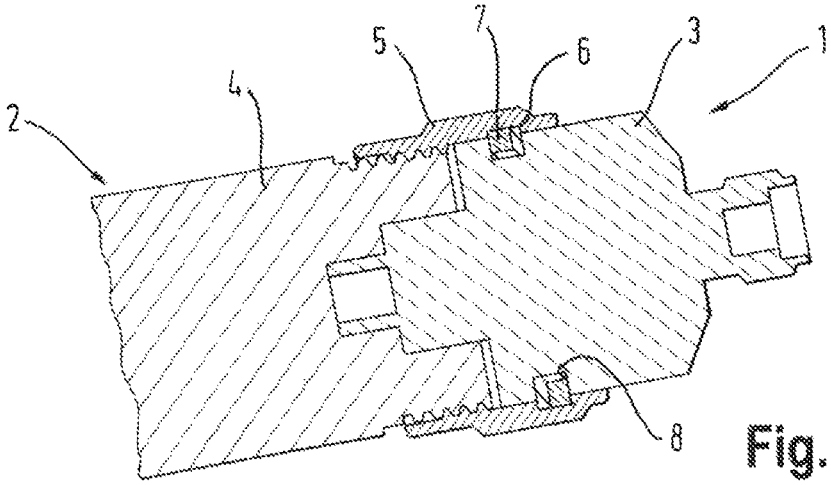
FIG. 3 is a longitudinal section through the insertion-type connection shown in FIG. 1.
Figure 4:
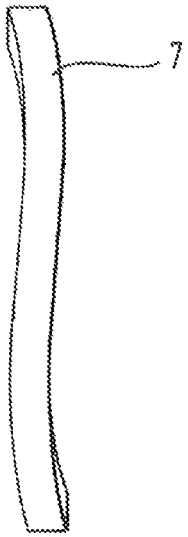
FIG. 4 is a first view from the side of the wave spring washer of the insertion-type connection.
Figure 5:
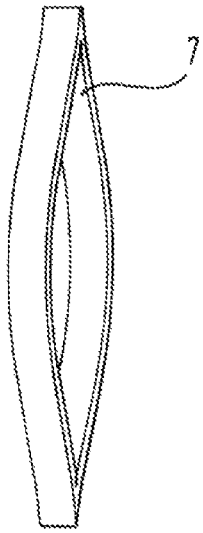
FIG. 5 is a second view from the side of the wave spring washer.

In FIGS. 4 and 5, the wave spring washer 7 is shown in two views from the side, which are rotated through 90° relative to one another on the longitudinal axis of the wave spring washer 7. The corrugated or wavy form of the annular resilient body of the wave spring washer 7 can clearly be seen in them. It is also in a largely unloaded state that the wave spring washer 7 is arranged in the insertion-type connection in the form in which it is shown in FIGS. 1 to 3. There, the union nut 5 has already been screwed to an outside thread which is formed by the conductor 4 of the coupler 2 at its insertion end, but has not yet been tightened to an intended operating torque. When the insertion-type connection is in the state shown in FIGS. 1 to 3, the conductors 3, 4 of the two insertion-type connectors are already in contact axially.

To achieve good transmission characteristics for radio-frequency signals on the part of the insertion-type connection, provision is made for a defined contact-making pressure to be reached at the axial contact-making faces of the two conductors 3, 4. To maintain this contact-making pressure, the union nut 5 is tightened to the intended operating torque, whereby it is moved in the direction of the coupler under increasing deformation of the wave spring washer 7 and hence under pre-loading thereof. In the course of this, the wave spring washer 7 is deformed into the (almost) flat shape shown in FIG. 6. The resilient pre-loading of the wave spring washer 7 caused by the deformation presses the conductor 3 of the plug 1 against the conductor 4 of the coupler 2 axially. The spring constant of the wave spring washer 7 is selected to be such in this case that an intended contact-making pressure is obtained at the axial contact-making faces of the conductors 3, 4 by the application of the intended operating torque.

Figure 6:
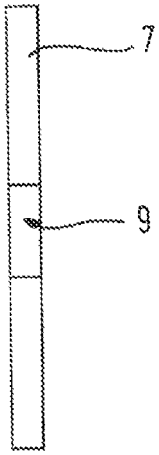
FIG. 6 is a view from the side of the wave spring washer in a deformed state.

It can be seen from FIG. 6 that the wave spring washer 7 is of C-shaped form and thus has a radial slot 9. As a result of this, the radial elasticity of the wave spring washer 7 is relatively high and this makes it easier for it to be introduced into the groove 6 in the union nut 5 and into the groove 8 in the conductor 3 of the plug 1.

In an embodiment which is not shown, the insertion-type connector may also take the form of a co-axial insertion-type connector. Provision may be made in this case for the conductors 3, 4 to be of a hollow form and for them each to receive a center conductor which is electrically insulated from the associated (outer) conductor 3, 4 by a dielectric and in particular by one or more insulating discs.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An insertion-type connector comprising:

a conductor; and a union nut rotatably mounted on the conductor, wherein the union nut is resiliently mounted on the conductor in the axial direction of the insertion-type connector via an annular spring stressed in bending that is deformed by rotationally tightening the union nut, and said annular spring retains said union nut on said conductor.

2. The insertion-type connector of claim 1, wherein the annular spring stressed in bending takes the form of a wave spring washer.

3. The insertion-type connector of claim 1, wherein the inside of the annular spring stressed in bending is arranged in a groove in the conductor and/or its outside is arranged in a groove in the union nut.

4. The insertion-type connector of claim 1, wherein the insertion-type connector takes the form of a co-axial insertion-type connector with the conductor, in the form of an outer conductor, surrounding a center conductor.

5. The insertion-type connector of claim 2, wherein the inside of the annular spring stressed in bending is arranged in a groove in the conductor and/or its outside is arranged in a groove in the union nut.

6. The insertion-type connector of claim 1, wherein the insertion-type connector takes the form of a co-axial insertion-type connector with the conductor, in the form of an outer conductor, surrounding a center conductor.

7. The insertion-type connector of claim 1, such that when the union nut is rotatable and secured in the axial direction to an intended torque it maintains limited, spring-loaded movement.

8. An electrical connector comprising:

a conductor;

an internally threaded connector rotatably arranged on said conductor, an internal thread of said internally threaded connector defining an axis of rotation; and a spring that, in a compressed state, effects a first force on said internally threaded connector in a first direction parallel to said axis of rotation and a second force on said conductor in a direction opposite said first force, wherein said spring limits a range of motion of said internally threaded connector relative to said conductor in both said first direction and said second direction.

9. The electrical connector of claim 8:

said internally threaded connector comprising a first groove on an inner circumference of said internally threaded connector, said conductor comprising a second groove on an outer circumference of said conductor, a first portion of said spring being situated in said first groove, and a second portion of said spring being situated in said second groove.

10. An electrical connector comprising:

a conductor;

an internally threaded connector rotatably arranged on said conductor, an internal thread of said internally threaded connector defining an axis of rotation; and a spring compressible in a direction parallel to said axis of rotation, said internally threaded connector comprising a first groove on an inner circumference of said internally threaded connector, said conductor comprising a second groove on an outer circumference of said conductor, a first portion of said spring being situated in said first groove, and a second portion of said spring being situated in said second groove.

11. The electrical connector of claim 10, wherein:

said spring is a C-shaped spring.

12. The electrical connector of claim 8, wherein:

said spring is a C-shaped spring.

13. An electrical connector comprising:

a conductor;

an internally threaded connector rotatably arranged on said conductor, an internal thread of said internally threaded connector defining an axis of rotation; and a spring that, in a compressed state, effects a first force on an internal surface of said internally threaded connector in a first direction parallel to said axis of rotation and a second force on said conductor in a direction opposite said first force, said internal surface facing another surface of said internally threaded connector.

14. The electrical connector of claim 13:

said internally threaded connector comprising a first groove on an inner circumference of said internally threaded connector, said conductor comprising a second groove on an outer circumference of said conductor, a first portion of said spring being situated in said first groove, and a second portion of said spring being situated in said second groove.

15. The electrical connector of claim 13, wherein:

said spring is a C-shaped spring.

16. The insertion-type connector of claim 1, wherein said annular spring is radially inward of said union nut.

17. An electrical connector comprising:

a first conductor;

a second conductor;

an internally threaded connector rotatably arranged on said first conductor, an internal thread of said internally threaded connector defining a tightening direction; and a spring that resiliently interconnects said first conductor and said internally threaded connector, a motion of said internally threaded connector in said tightening direction resulting from a rotational tightening of said internally threaded connector to said second conductor effects a compression of said spring.

18. The electrical connector of claim 17, wherein:

said spring is a C-shaped spring.

19. An RF electrical connector comprising:

a conductor;

an internally threaded connector rotatably arranged on said conductor; and a spring that resiliently interconnects said conductor and said internally threaded connector, said conductor extends through said internally threaded connector, a first end of said conductor protruding in a first direction beyond a first end of said internally threaded connector, and a second end of said conductor opposite said first end of said conductor protruding in a second direction opposite said first direction beyond a second end of said internally threaded connector opposite said first end of said internally threaded connector.

20. The RF electrical connector of claim 19, wherein: said spring is a C-shaped spring.

* * * * *